United States Patent [19]

Hrabalek

[11] 4,358,060

[45] Nov. 9, 1982

[54] DEVICE FOR THE TREATMENT OF BULK MATERIAL

[76] Inventor: Ernst Hrabalek, Brantinggasse 27, 1100 Vienna, Austria

[21] Appl. No.: 204,287

[22] Filed: Nov. 5, 1980

[30] Foreign Application Priority Data

Nov. 8, 1979 [AT] Austria ..... 7169/79

[51] Int. Cl.[3] ..... B02C 18/22; B02C 18/24

[52] U.S. Cl. ..... 241/65; 241/242

[58] Field of Search ..... 241/30, 29, 152 A, 242, 241/65, 66

[56] References Cited

U.S. PATENT DOCUMENTS 3,164,330 1/1965 Neidl ..... 241/280 X 4,174,906 11/1979 Richard ..... 241/30 X

*Primary Examiner*—Willie G. Abercrombie

*Attorney, Agent, or Firm*—Karl F. Ross

[57] ABSTRACT

A device for the comminution or other treatment of bulk material comprises one or more modular units of prismatic, preferably cubic, shape with two intersecting throughgoing bores, one of them being circular and the other square in cross-section. A rotary shaft carrying one or more tools extends axially in the circularly sectioned bore of at least one module and is driven by a motor fastened to a face thereof; the square-sectioned bore forms an inlet and an outlet for the goods to be treated. At least the apertured sides of each module have passages facilitating its connection to an adjoining module or to a cover; other attachments on the solid sides of the unit may be provided with channels for the circulation of a cooling fluid.

10 Claims, 14 Drawing Figures

FIG.6a
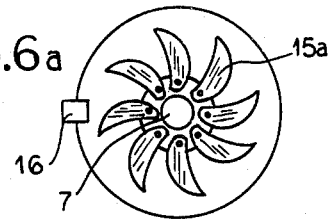
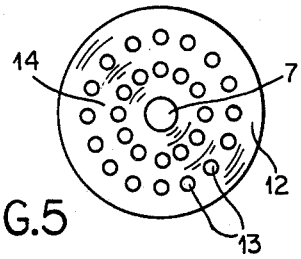
FIG.5
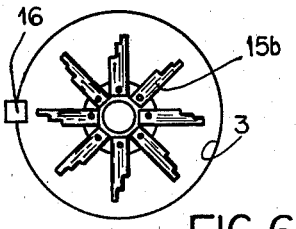
FIG.6b
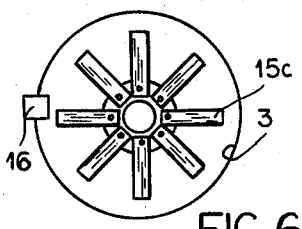
FIG.6c
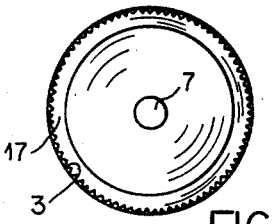
FIG.7
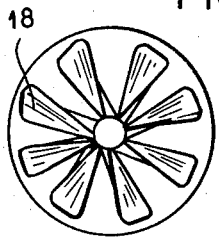
FIG.8
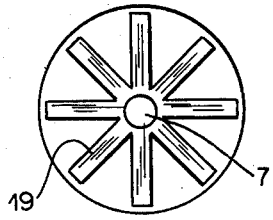
FIG.9
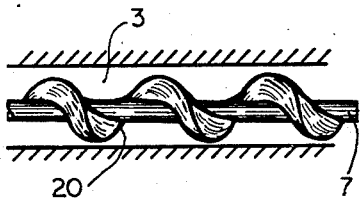
FIG.10
FIG.3
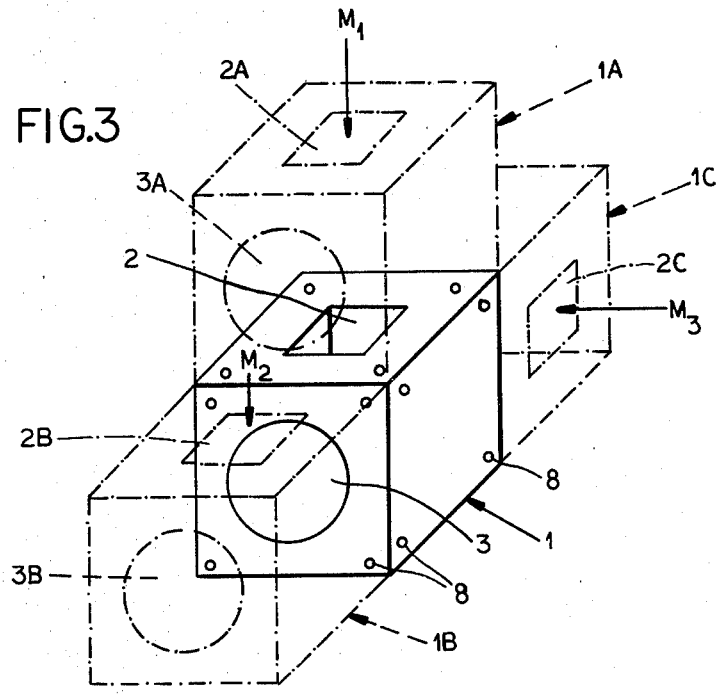

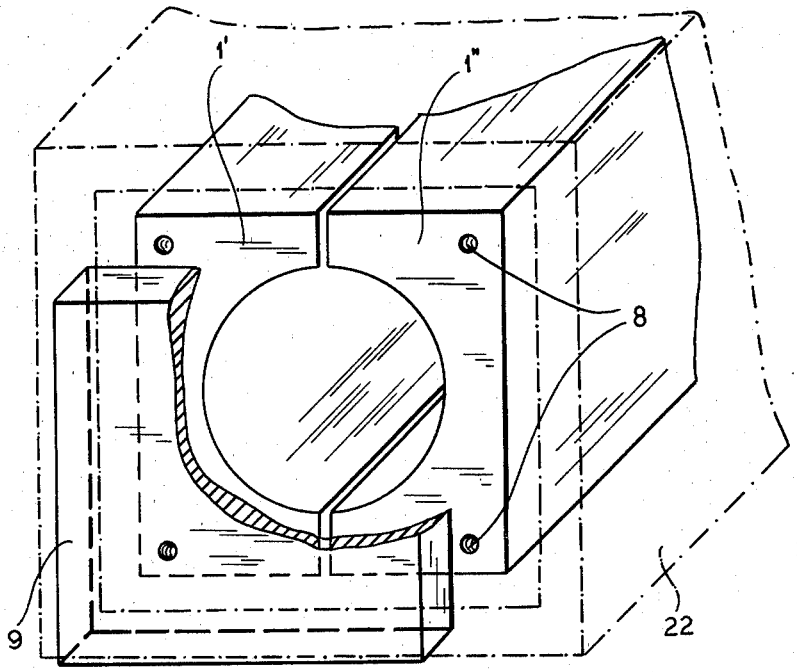
FIG.12
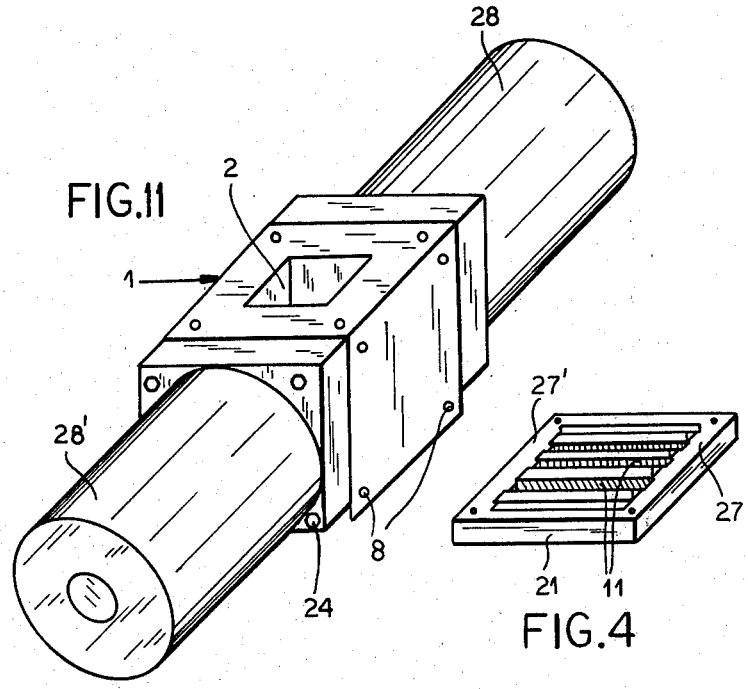
FIG.11
FIG.4

DEVICE FOR THE TREATMENT OF BULK MATERIAL

FIELD OF THE INVENTION

My present invention relates to a device for the treatment of bulk material, i.e. for comminuting, mixing, conveying and/or dosing organic or inorganic matter passing from an inlet to an outlet.

BACKGROUND OF THE INVENTION

Conventional equipment for grinding, blending or otherwise treating such material is generally designed for only one specific task. If different treatment steps are to be combined, relative complex structures are needed for this purpose.

OBJECT OF THE INVENTION

The object of my present invention, therefore, is to provide an improved device which can be readily adapted to different modes of treatment, individually or in combination.

SUMMARY OF THE INVENTION

I realize this object, in accordance with my present invention, by the provision of a modular unit in the form of a prismatic block with six sides, preferably a cube, this block having a first throughgoing bore extending between a first pair of sides and a second throughgoing bore extending between a second pair of sides thereof while intersecting the first bore. At least the aforementioned pairs of sides are provided with mounting formations offset from their bores which serve on the one hand for securing a drive motor—directly or indirectly—to one of the sides of the first pair and on the other hand for the optional attachment of substantially identical modular units to sides of the block not occupied by that motor. The motor shaft, extending into the block along the axis of the first bore which preferably has a circular cross-section, carries one or more tools in the region of intersection of the two bores whereby bulk material entering the block from the inlet end of the second bore is processed (e.g. comminuted or stirred) before leaving that bore at its outlet end. The second bore advantageously has a cross-section distinct from that of the first bore, preferably square to allow for maximum throughput with a given minimum wall thickness.

The mounting formations may simply be threaded holes preferably extended into throughgoing passages accommodating long bolts by which, for example, a motor flange on one side and a cover on the opposite side may be jointly secured to the block. To facilitate cleaning, and possibly an exchange of tools, the block may be split into two halves held together upon assembly by the motor housing and the cover.

BRIEF DESCRIPTION OF THE DRAWING

The above and other features of my invention will now be described in detail with reference to the accompanying drawing in which:

FIG. 3 is a perspective view of the block of FIG. 1, illustrating the possibility of combining it with similar modular units;

FIG. 4 is a perspective view of an optional attachment with channels for the circulation of a temperature-controlling fluid;

FIGS. 5, *6a*, *6b*, *6c* and 7–10 are face views of a variety of tools adapted to be used in the assembly of FIG. 3;

FIG. 11 is a perspective view illustrating a device similar to that of FIG. 2 but with a second motor replacing its cover; and FIG. 12 is a fragmentary perspective view of a modification of the device of FIG. 2 comprising a split block.

SPECIFIC DESCRIPTION

Figure 1:
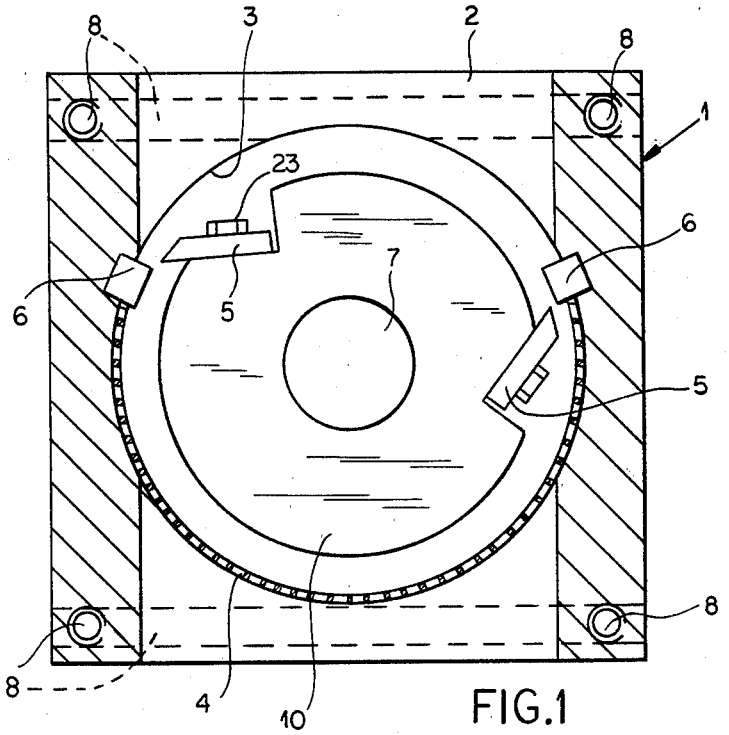
FIG. 1 is a cross-sectional view of a one-block device embodying my invention.
Figure 2:
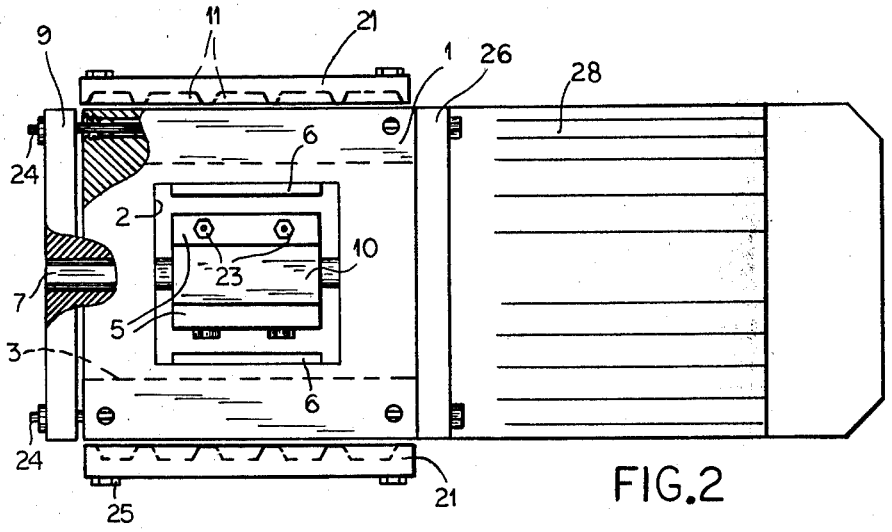
FIG. 2 is a top view of the device shown in FIG. 1, drawn to a smaller scale and including a motor as well as a cover.

In FIGS. 1 and 2 I have shown a cubic block 1 (see also FIG. 3) provided with two large throughgoing bores intersecting at its center, namely a bore 2 of square cross-section and a bore 3 of circular cross-section. The block is further provided in the vicinity of its edges with throughgoing passages 8 having threaded extremities so as to accommodate either long bolts 24 or short screws 25. The bolts 24 are seen in FIG. 2 to pass through a flange 26 of an electric motor 28 as well as through a cover 9, adjoining opposite sides of the block 1 with which they are assembled in a compact structure.

Motor 28 has a shaft 7 which extends into the block 1 along the axis of bore 3, the cover 9 acting as a counterbearing for that shaft. A cylindrical body 10 on shaft 7 carries a pair of knives 5 coacting with stationary knives 6 in opposite walls of the square-section bore 2 to comminute bulk material admitted at the upper end of the latter bore and discharged at its lower end. FIG. 1 also shows a screen 4 suspended at the intersection of bores 2 and 3 below the rotary tool carrier 10 to intercept insufficiently comminuted material.

FIG. 2 further shows the possibility of mounting, with the aid of screws 25, a pair of cooling attachments 21 on the solid sides of block 1. These attachments, as more clearly shown in FIG. 4, have ribs forming cooling channels 11 through which air or a liquid fluid can be passed by way of manifolds 27 and 27' adapted to be connected, by means not further illustrated, in a suitable fluid-circulating system.

As illustrated in FIG. 3, the device shown in FIGS. 1 and 2 may be extended with the aid of additional modular blocks 1A, 1B, 1C attached to block 1 at several sides thereof. Unit 1B is shown to have a circular-section bore 3B in line with bore 3 while unit 1A has a square-section bore 2A in line with bore 2. Bore 3B may be used to accommodate the shaft of a motor attached to the free face of block 1B opposite block 1 and extended into block 1. Block 1A may have its own motor, with a shaft extending in its bore 3A to chop one kind of material $M_1$, fed into its bore 2A, whereas some other kind of material $M_2$ enters bore 2B of block 1B for advance by a feed screw driven by the first-mentioned motor into block 1 while the same or a further motor feeds a third kind of material $M_3$, entering the block 1C through its bore 2C, to the intersection of bores 2 and 3 of block 1. After blending at that intersection, the resulting mixture will be discharged at the bottom end of bore 2. The ends of bores not used for admission or discharge of material to be treated will of course be plugged or closed by external bores.

In FIG. 5 I have shown, schematically, the shaft 7 carrying a disk 12 with pins 13 which can coact with a counterrotating second disk, not shown, having pins engaging in the angular space 14 between pins 13. FIGS. *6a, 6b, 6c* illustrate a variety of hammers 15*a*, 15*b*, 15*c* coacting with a stationary anvil 16 in the wall of bore 3. FIG. 7 illustrates a cylindrical scraper 17 carried by a shaft 7. FIG. 8 shows the shaft 7 carrying a set of vanes 18 to form a blower. In FIG. 9 the shaft is provided with a dosing wheel 19 having sectoral coutouts. FIG. 10 illustrates a conveyor screw 20 adapted to be used as feeder in the assembly of FIG. 3.

In FIG. 11 I have shown the block 1 provided with two motors 28 and 28' attached to opposite sides thereof, motor 28' replacing the cover 9 of FIG. 2. Thus, for example, the two disks of the pin mill partly shown in FIG. 5 may be rotated by motors 28 and 28', respectively.

FIG. 12 shows the block split into two halves 1' and 1'' held together on one side by the cover 9 and on the opposite side by the motor flange 26 of FIG. 2. The assembly can be tightly fitted into an integral prismatic shell 22 of sound-absorbing material (e.g. a foam polymer) having nonillustrated apertures which register with the inlet and outlet ends of bore 2 (FIG. 1). Such a sound-absorbing housing, advantageously extending over the cover 9 and the motor on the opposite side of the unit, may of course also be provided in the case of a solid block 1 and may further envelop the cooling attachments 21 of FIGS. 2 and 4.

I prefer to make the block 1 of light, noncorrosive metal of good thermal conductivity, such as aluminum, facilitating heat exchange between its interior and either the ambient air or the aforementioned cooling attachments.

I claim:

1. A device for the treatment of bulk material, comprising:

a modular unit in the form of a prismatic block with six sides having a first throughgoing bore extending between a first pair of said sides and a second throughgoing bore extending between a second pair of said sides while intersecting said first bore, at least said first and second pairs of sides being provided with mounting formations offset from said bores;

a drive motor secured to one of the sides of said first pair by the mounting formations thereof and provided with a shaft extending into said block along the axis of said first bore; and tool means on said shaft in a region of intersection of said bores, said second bore forming an inlet and an outlet for bulk material to be processed by said tool means, said mounting formations enabling the attachment of substantially identical modular units to sides of said block not occupied by said drive motor.

2. A device as defined in claim 1, further comprising a cover secured to the other of the sides of said first pair by the mounting formations thereof.

3. A device as defined in claim 2 wherein said block is split into two symmetrical halves held together by said cover.

4. A device as defined in claims 1, 2 or 3, further comprising an integral prismatic housing of sound-absorbent material tightly embracing said block.

5. A device as defined in claims 2 or 3 wherein said cover forms a counterbearing for said shaft.

6. A device as defined in claims 1, 2 or 3 wherein said first bore has a circular cross-section and said second bore has a square cross-section.

7. A device as defined in claim 6 wherein said block is of cubic shape.

8. A device as defined in claims 1, 2 or 3 wherein said mounting formations are throughgoing passages with threaded extremities.

9. A device as defined in claim 1, further comprising a second motor secured to the other of the sides of said first pair by the mounting formations thereof, said second motor having another tool-carrying shaft extending into said first bore.

10. A device as defined in claims 1, 2, 3 or 9 wherein at least one further side of said block is provided with mounting means, further comprising an attachment with channels for the circulation of a temperature-controlling fluid joined to said further side by said mounting means.

* * * * *